United States Patent [19]

Budnik

[11] 4,060,787

[45] Nov. 29, 1977

[54] THERMAL SWITCH

[75] Inventor: Frederick Budnik, St. Paul, Minn.

[73] Assignee: Minnesota Mining and Manufacturing Company, St. Paul, Minn.

[21] Appl. No.: 741,216

[22] Filed: Nov. 12, 1976

[51] Int. Cl.[2] ..... H01H 37/76

[52] U.S. Cl. ..... 337/408; 337/409

[58] Field of Search ..... 337/409, 408, 407, 402, 337/403, 404, 405, 410, 411, 108, 148, 401

[56] References Cited

U.S. PATENT DOCUMENTS

| | | | |
|---|---|---|---|
| 3,519,912 | 7/1970 | Merrill | 337/407 |
| 3,930,215 | 12/1975 | Senor | 337/407 |
| 3,944,960 | 3/1976 | Audette et al. | 337/408 |

*Primary Examiner*—Harold Broome

*Attorney, Agent, or Firm*—Cruzan Alexander; Donald M. Sell; Terryl K. Qualey

[57] ABSTRACT

A thermal switch having a tubular metal casing within which a fusible pellet normally holds an axially slidable electrical contact disk in contact with an electrical lead. The body of the electrical lead extends through a ceramic bushing and out of the casing for electrical connection, and it is formed with at least one radially-extending relief lying within the bore of the ceramic bushing. A sealing resin within the bore of the ceramic bushing and around the lead retains the lead in the bushing both in normal use and after the fusible pellet has melted and the electrical connection is broken.

5 Claims, 4 Drawing Figures

THERMAL SWITCH

FIELD OF THE INVENTION

The present invention relates to a thermal switch in which a fusible pellet melts at a predetermined temperature to break the electrical connection through the switch.

BACKGROUND OF THE INVENTION

Thermal switches having a temperature-sensitive pellet and a sliding, star-shaped, contact disk, in which the sliding disk moves away from an electrical lead mounted in a ceramic bushing to break the electrical connection when the pellet melts, are disclosed in U.S. Pat. No. 3,180,958. In the thermal switches of this type in general use today, the body of the electrical lead extending through the ceramic bushing is smooth and it is retained in the ceramic bushing by a sealing resin within the bore of the ceramic bushing and extending out over the outer surface of the bushing around the lead. Electrical connection is normally made through the lead extending through the ceramic bushing which contacts the sliding disk. The sliding disk in turn contacts the wall of the tubular metal casing of the switch and the electrical connection is continued out through an electrical lead connected to the casing. When an over-temperature condition arises, the fusible pellet melts and a spring moves the sliding disk away from its contact with the electrical lead to break the electrical circuit. Such thermal switches are used, for example, in home coffee-making units now in wide use.

It has now been found that when a home appliance containing such a thermal switch overheats, causing the switch to open, the home handyman will often attempt to fix the appliance himself. In doing so, he may push and twist the electrical lead extending through the ceramic bushing and break loose the resin bond between the smooth-bodied electrical lead and the ceramic bushing. Once the resin bond is broken the electrical lead can be moved axially to make contact with the sliding disk and thus remake the electrical circuit, but without solving the problem in the appliance which caused the over-temperature condition in the first place. There no longer being a thermal switch in the circuit, the over-temperature condition can now reoccur and worsen to cause a fire.

THE PRESENT INVENTION

The present invention provides a thermal switch comprising a tubular, electrically and thermally conductive metal casing and a first electrically conductive lead joined to and extending from one end of the metal casing to seal off the end and make electrical connection to the casing. An insulative ceramic bushing seals the opposite end of the casing with the bore in the ceramic bushing coaxial with the casing. A normally solid, fusible pellet is positioned within the casing adjacent the end sealed by the first electrical lead. A second electrically conductive lead has a generally cylindrical body extending through the bore of the ceramic bushing and out of the casing for electrical connection thereto and it has a head abutting the end of the ceramic bushing within the casing. The body of the second lead is formed with at least one radially-extending relief within the bore of the ceramic bushing, the relief extending around less than the entire circumference of the body and the second lead being retained in the ceramic bushing by sealing resin within the bore of the bushing around the body of the lead. An electrically conductive disk is positioned within the casing between the fusible pellet and the head of the second lead coaxial with the casing, is slidable axially within the casing and makes electrical contact with the wall of the casing. Resilient means urges the disk into electrical contact with the head of the second lead when the fusible pellet is solid and away therefrom upon melting of the fusible pellet.

The formation of at least one radially-extending relief in the portion of the generally cylindrical body within the bore of the ceramic bushing provides a pocket in the surface of the lead for sealing resin to form a block between the ceramic bushing and the electrical lead to aid in preventing axial movement of the lead relative to the bushing. The provision that the relief not extend around the entire circumference of the lead also assures that the resin block will prevent rotation of the electrical lead which might break the bond between the lead and the ceramic bushing.

THE DRAWING

The thermal switch of the present invention includes a tubular, electrically and thermally conductive metal casing 10. One end of the casing 10 is turned inward to form a smaller diameter opening in which one end of a first electrically conductive lead 12 is swaged to join the lead to the metal casing and to seal off the end of the casing 10. The lead 12 is thus electrically connected to the metal casing 10 and extends outward therefrom.

An insulative ceramic bushing 14 is positioned at the opposite end of the casing 10, the bushing 14 sealing the end of the casing and having its bore coaxial with the casing. The metal casing 10, in its area of contact with the ceramic bushing 14, is formed with a lesser wall thickness and the end of the casing is turned over to restrain axial movement of the ceramic bushing 14 relative to the metal casing 10.

A normally solid, fusible pellet 16 is positioned within the casing 10 adjacent the end having the first lead 12. The fusible pellet 16 is chosen to have a melting temperature corresponding to a temperature that indicates failure of the electrical device in which the thermal switch is to be used.

Figure 1:
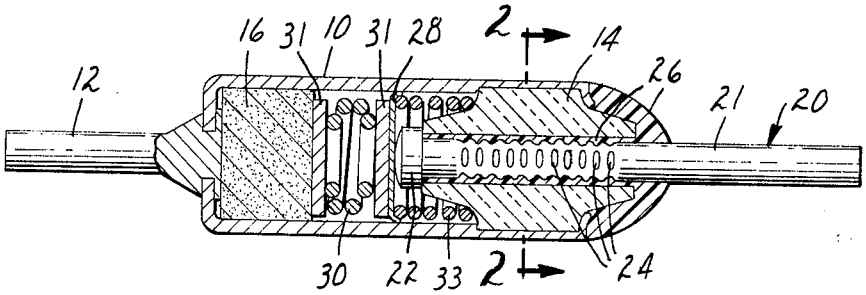
FIG. 1 is a longitudinal cross-sectional view of a thermal switch constructed in accordance with the present invention.
Figure 2:
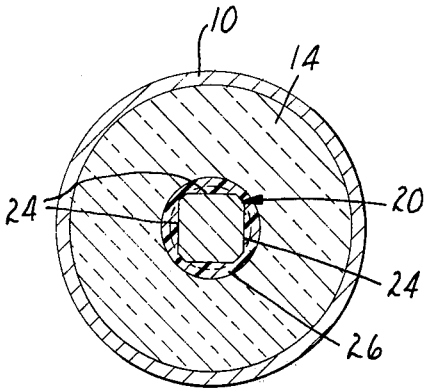
FIG. 2 is a cross-sectional view taken generally along line 2—2 of FIG. 1.
Figure 3:
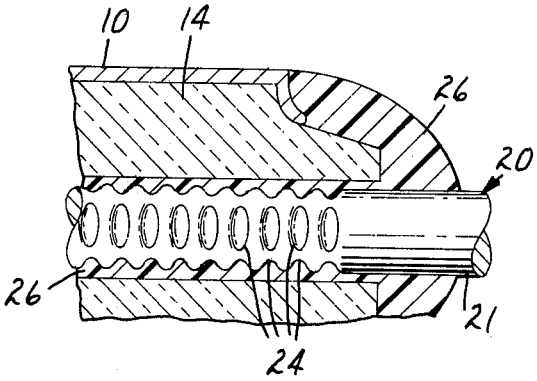
FIG. 3 is a longitudinal cross-sectional view of a portion of the thermal switch of FIG. 1.
Figure 4:
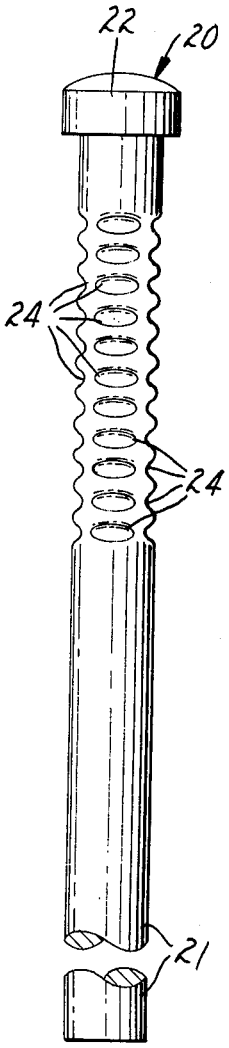
FIG. 4 is a longitudinal view of one of the electrical leads of the thermal switch of FIG. 1.

A second electrically conductive lead 20 has a generally cylindrical body 21 extending through the bore of the ceramic bushing 14 and out of the casing 10 to permit electrical connection thereto. The second lead 20 is formed with a head 22 which abuts the end of the ceramic bushing 14 within the casing 10. The body 21 of the second lead is formed with a plurality of radially-extending indentations or reliefs 24 formed in each of a plurality of circumferential rings within the bore of the ceramic bushing 14. The indentations 24 in any given circumferential ring extend around less than the entire circumference of the body 21. The second lead 20 is retained in the ceramic bushing 14 by a sealing resin 26 within the bore of the bushing 14 around the body 21 of the second lead 20. The configuration of indentations 24 in the illustrated embodiment with four equally spaced indentations in each circumferential ring is preferred. This configuration deforms the body 21 of the second lead 20 into a generally square shape at the cross-section of the indentations 24, as illustrated in FIG. 2. The diagonal of the square cross-section is greater than the diameter of the major cylindrical portion of the body 21 and it just fits within the ceramic bushing 14 thereby to center the cylindrical body 21 in the bore of the bushing 14. This assures that the sealing resin 26 will flow down around and completely bond the cylindrical body 21 to the ceramic bushing 14. The indentations 24 provide pockets for the sealing resin 26 such that when the sealing resin 26 hardens, it forms blocks in the identations 24 preventing axial movement of the second lead 20 relative to the ceramic bushing 14. The provision that the indentations 24 in a circumferential ring do not completely encompass the circumference of the lead body 21 also provides resin blocks against torsion applied to the lead such as when the lead is bent and twisted.

It has been found that the depth of the indentations 24 or other relief utilized should be 2 to 15% of the diameter of the body 21 of the lead 20. A minimum of 2% is required before significant improvement in the bond between the second lead 20 and the ceramic brushing 14 is noticed. A maximum indentation depth of 15% of the diameter of the body 21 is preferred because at greater depths the cross-section of the lead is sufficiently reduced to significantly decrease the electrical path through the lead.

An electrically conductive disk 28 is positioned within the metal casing 10 between the head 22 of the second lead 20 and the fusible pellet 16 coaxial with the casing 10, is slidable axially within the casing and makes electrical contact with the wall of the casing 10. In the illustrated embodiment the contact disk 28 is in the form of a star contact having radial spokes with the ends thereof turned out of the plane of the disk to facilitate sliding contact with the wall of the casing 10.

A compression spring 30 is positioned between the contact disk 28 and the fusible pellet 16 and lies between a pair of spacer disks 31 to normally hold the star contact disk 28 in contact with the head 22 of the second lead 20. The electrical circuit is thus completed from the first lead 12 through the metal casing 10 and the star contact disk 28 and out through the second lead 20. A trip spring 33 is positioned between the ceramic bushing 14 and the star contact disk 28 to urge the star contact disk 28 away from the head 22 of the second lead 20 when the fusible pellet 16 melts, thus to break the electrical circuit through the thermal switch.

In comparative tests, thermal switches having leads 20 and similar switches having leads without indentations were subjected to over-temperature conditions and an axial force was then applied to the leads. The leads all had diameters of 1.024 millimeter and the leads 20 had indentations 24 as illustrated with a depth of 0.13 millimeter. The axial force required to break the bond between the lead 20 and the ceramic bushing 14 was consistently over 90 newtons, well above the force that the home handyman can generate with finger pressure. The axial force required to break the bond when a straight lead was used was consistently less than 25 newtons, which is below the force that can be generated with finger pressure alone, and averaged only 6 newtons.

I claim:

1. A thermal switch comprising:

a tubular, electrically and thermally conductive metal casing, a first electrically conductive lead joined to and extending from one end of said metal casing to seal off said one end and make electrical connection to said casing, an insulative ceramic bushing at the opposite end of said casing, said bushing sealing said opposite end of said casing and having its bore coaxial with said casing, a normally solid, fusible pellet within said casing adjacent to said one end, a second electrically conductive lead having a generally cylindrical body extending through the bore of said ceramic bushing and out of said casing to permit electrical connection thereto, and having a head abutting the end of said ceramic bushing within said casing, said body of said second lead being formed with at least one radially-extending relief lying within the bore of said ceramic bushing, said relief extending around less than the entire circumference of said body, said second lead being retained in said ceramic bushing by a sealing resin within the bore of said bushing around the body of said second lead, an electrically conductive disk positioned within said casing between said fusible pellet and said head of said second lead coaxial with said casing, slidable axially within said casing and making electrical contact with the wall of said casing, and resilient means urging said disk into electrical contact with the head of said second lead when said fusible pellet is solid and away therefrom upon melting of said fusible pellet.

2. The thermal switch of claim 1 wherein each said relief has a depth of 2 to 15 percent of the diameter of said body of said second lead.

3. The thermal switch of claim 1 wherein said body of said second lead is formed with a plurality of said reliefs in the form of a plurality of radial indentations formed in each of a plurality of circumferential rings.

4. The thermal switch of claim 3 wherein each circumferential ring of radial indentations consists of four equally spaced indentations.

5. The thermal switch of claim 3 wherein each said indentation has a depth of 2 percent to 15 percent of diameter of said body of said second lead.

* * * * *